US008200483B2

(12) United States Patent
Sato et al.

(10) Patent No.: US 8,200,483 B2
(45) Date of Patent: Jun. 12, 2012

(54) ADAPTIVE SOUND SOURCE VECTOR QUANTIZATION DEVICE, ADAPTIVE SOUND SOURCE VECTOR INVERSE QUANTIZATION DEVICE, AND METHOD THEREOF

(75) Inventors: Kaoru Sato, Kanagawa (JP); Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 446 days.

(21) Appl. No.: 12/518,944

(22) PCT Filed: Dec. 14, 2007

(86) PCT No.: PCT/JP2007/074136

§ 371 (c)(1),
(2), (4) Date: Jun. 12, 2009

(87) PCT Pub. No.: WO2008/072735

PCT Pub. Date: Jun. 19, 2008

(65) Prior Publication Data

US 2010/0082337 A1 Apr. 1, 2010

(30) Foreign Application Priority Data

Dec. 15, 2006 (JP) ..... 2006-338342

(51) Int. Cl.
*G10L 19/12* (2006.01)

(52) U.S. Cl. ..... 704/222; 704/200; 704/200.1

(58) Field of Classification Search ..... 704/200–201, 704/500–503

See application file for complete search history.

(56) References Cited

U.S. PATENT DOCUMENTS 5,995,927 A * 11/1999 Li ..... 704/246
6,330,531 B1 * 12/2001 Su ..... 704/204
6,397,176 B1 * 5/2002 Su ..... 704/220
6,584,437 B2 * 6/2003 Heikkinen et al. ..... 704/207
6,947,889 B2 9/2005 Yasunaga et al.
6,988,065 B1 1/2006 Yasunaga et al.
7,383,176 B2 6/2008 Yasunaga et al.
2005/0058208 A1 3/2005 Ehara
2005/0089172 A1 * 4/2005 Fujimoto ..... 380/275
2005/0197833 A1 * 9/2005 Yasunaga et al. ..... 704/223

(Continued)

FOREIGN PATENT DOCUMENTS

EP 0607989 7/1994

(Continued)

OTHER PUBLICATIONS

English language Abstract of JP 8-248995 A, Sep. 27, 1996.

(Continued)

*Primary Examiner* — Douglas Godbold
(74) *Attorney, Agent, or Firm* — Greenblum & Bernstein, P.L.C.

(57) ABSTRACT

Disclosed is an adaptive excitation vector quantization device capable of improving quantization accuracy of adaptive excitation vector quantization while suppressing increase of the calculation amount in CELP encoding which performs encoding in sub-frame units. An adaptive excitation vector generator cuts out an adaptive excitation vector of a frame length (n) from an adaptive excitation codebook. An impulse response matrix former forms a n×n impulse response matrix using impulse response matrixes of sub-frames inputted from a synthesis filter. A target vector generator adds a linear prediction residual vector of each sub-frame to form a target vector of frame length (n). An evaluation measure calculator calculates an evaluation measure of the adaptive excitation vector quantization by using the adaptive excitation vector, the impulse response matrix, and the target vector.

7 Claims, 3 Drawing Sheets

U.S. PATENT DOCUMENTS

| | | | | |
|---|---|---|---|---|
| 2007/0156395 | A1 * | 7/2007 | Ojala | 704/211 |
| 2007/0179783 | A1 * | 8/2007 | Manjunath et al. | 704/230 |
| 2010/0106492 | A1 | 4/2010 | Sato et al. | |

FOREIGN PATENT DOCUMENTS

| | | | |
|---|---|---|---|
| EP | 1093116 | A1 * | 4/2001 |
| EP | 2101320 | | 9/2009 |
| JP | 8-248995 | A | 9/1996 |
| JP | 10-242867 | A | 9/1998 |
| JP | 2000-298500 | A | 10/2000 |
| JP | 2005-091749 | A | 4/2005 |
| WO | WO95/16260 | A1 * | 6/1995 |

OTHER PUBLICATIONS

English language Abstract of JP 10-242867 A, Sep. 11, 1998.

English language Abstract of JP 2005-091749 A, Apr. 7, 2005.

English language Abstract of JP 2000-298500 A, Oct. 24, 2000.

Schroeder et al., "Code-Excited Linear Prediction (CELP): High-Quality Speech at Very Low Rates," IEEE Proceedings, ICASSP 1985,pp. 937-940.

ITU-T Recommendation G.729, "General Aspects of Dogital Transmission Systems: Coding of Speech at 8 kbit/s using Conjugate-Structure Algebraic-Code-Excited Linear Prediction (CS-ACELP)," Mar. 1996, pp. 17-19.

U.S. Appl. No. 12/518,943 to Sato et al, which was filed Jun. 12, 2009.

Extended Search report from E.P.O. in EP 07850640.9, mail date is Aug. 5, 2011.

* cited by examiner

ADAPTIVE SOUND SOURCE VECTOR QUANTIZATION DEVICE, ADAPTIVE SOUND SOURCE VECTOR INVERSE QUANTIZATION DEVICE, AND METHOD THEREOF

TECHNICAL FIELD

The present invention relates to an adaptive excitation vector quantization apparatus, adaptive excitation vector dequantization apparatus and quantization and dequantization methods for vector quantization of adaptive excitations in CELP (Code Excited Linear Prediction) speech coding. In particular, the present invention relates to an adaptive excitation vector quantization apparatus, adaptive excitation vector dequantization apparatus and quantization and dequantization methods for vector quantization of adaptive excitations used in a speech encoding and decoding apparatus that transmits speech signals, in fields such as a packet communication system represented by Internet communication and a mobile communication system.

BACKGROUND

In the field of digital radio communication, packet communication represented by Internet communication, speech storage and so on, speech signal encoding and decoding techniques are essential for effective use of channel capacity and storage media for radio waves. In particular, a CELP speech encoding and decoding technique is a mainstream technique (for example, see non-patent document 1).

A CELP speech encoding apparatus encodes input speech based on speech models stored in advance. To be more specific, the CELP speech encoding apparatus divides a digital speech signal into frames of regular time intervals, for example, frames of approximately 10 to 20 ms, performs a linear prediction analysis of a speech signal on a per frame basis to find the linear prediction coefficients ("LPC's") and linear prediction residual vector, and encodes the linear prediction coefficients and linear prediction residual vector individually. A CELP speech encoding or decoding apparatus encodes or decodes a linear prediction residual vector using an adaptive excitation codebook storing excitation signals generated in the past and a fixed codebook storing a specific number of fixed-shape vectors (i.e. fixed code vectors). Here, while the adaptive excitation codebook is used to represent the periodic components of a linear prediction residual vector, the fixed codebook is used to represent the non-periodic components of the linear prediction residual vector that cannot be represented by the adaptive excitation codebook.

Further, encoding or decoding processing of a linear prediction residual vector is generally performed in units of subframes dividing a frame into shorter time units (approximately 5 ms to 10 ms). In ITU-T Recommendation G. 729 disclosed in Non-Patent Document 2, an adaptive excitation is vector-quantized by dividing a frame into two subframes and by searching for the pitch periods of these subframes using an adaptive excitation codebook. Such a method of adaptive excitation vector quantization in subframe units makes it possible to reduce the amount of calculations compared to the method of adaptive excitation vector quantization in frame units.

Non-Patent Document 1: M. R. Schroeder, B. S. Atal "IEEE proc. ICASSP" 1985, "Code Excited Linear Prediction: High Quality Speech at Low Bit Rate], pages 937-940

Non-Patent Document 2: "ITU-T Recommendation G. 729," ITU-T, 1996/3, pages 17-19

DISCLOSURE OF INVENTION

Problem to be Solved by the Invention

However, regarding the amount of information involved in the pitch period search processing in subframe units, in an apparatus that performs the above-noted adaptive excitation vector quantization in subframe units, for example, when one frame is divided into two subframes, the amount of information involved in adaptive excitation vector quantization per subframe is half the overall amount of information. Consequently, when the overall amount of information involved in adaptive excitation vector quantization is reduced, there is a problem that the amount of information to use for each subframe is further reduced, the range of pitch period search per subframe is limited, and the accuracy of adaptive excitation vector quantization degrades. For example, when the amount of information that is assigned to an adaptive excitation codebook is 8 bits, there are 256 patterns of pitch period candidates to search for. However, when this information amount of 8 bits is equally distributed to two subframes, a pitch period search is performed using 4 bits of information in one subframe. Consequently, there are 16 patterns of pitch period candidates to search for in each subframe, and variations to express pitch periods are insufficient. On the other hand, if a CELP speech encoding apparatus limits frame-unit processing to adaptive excitation vector quantization processing and performs other processing than adaptive excitation vector quantization in subframe units, it is possible to suppress an increased of the amount of calculations due to the adaptive excitation vector quantization, within an acceptable level.

It is therefore an object of the present invention to provide an adaptive excitation vector quantization apparatus, adaptive excitation vector dequantization apparatus, and quantization and dequantization methods that can suppress an increase of the amount of calculations, expand the range of pitch period search and improve the accuracy of quantization of adaptive excitation vector quantization, in CELP speech coding for performing linear prediction coding in subframe units.

Means for Solving the Problem

The adaptive excitation vector quantization apparatus of the present invention that is used in code excited linear prediction speech encoding to generate linear prediction residual vectors of a length m and linear prediction coefficients by dividing a frame of a length n into a plurality of subframes of the length m and performing a linear prediction analysis (where n and m are integers, and n is an integral multiple of m), employs a configuration having: an adaptive excitation vector generating section that cuts out an adaptive excitation vector of the length n from an adaptive excitation codebook; a target vector forming section that forms a target vector of the length n by adding the linear prediction residual vectors of the plurality of subframes; a synthesis filter that generates m×m impulse response matrixes using the linear prediction coefficients of the plurality of subframes; an impulse response matrix forming section that forms a n×n impulse response matrix using the m×m impulse response matrixes; an evaluation measure calculating section that calculates an evaluation measure of adaptive excitation vector quantization per pitch period candidate, using the adaptive excitation vector of the length n, the target vector of the length n and the n×n impulse response matrix; and an evaluation measure comparison section that compares the evaluation measures with respect to the pitch period candidates and calculates a pitch period of a highest evaluation measure as a quantization result.

The adaptive excitation vector dequantization apparatus of the present invention that is used in code excited linear prediction speech decoding to decode encoded information acquired by dividing a frame into a plurality of subframes and performing a linear prediction analysis in code excited linear prediction decoding, employs a configuration having: a storage section that stores a pitch period acquired by performing adaptive excitation vector quantization of the frame in the code excited linear prediction speech coding; and an adaptive excitation vector generating section that uses the pitch period as a cutting point and cuts out an adaptive excitation vector of a subframe length m from an adaptive excitation codebook.

The adaptive excitation vector quantization method of the present invention that is used in code excited linear prediction speech encoding to generate linear prediction residual vectors of a length m and linear prediction coefficients by dividing a frame of a length n into a plurality of subframes of the length m and performing a linear prediction analysis (where n and m are integers, and n is an integral multiple of m), employs a configuration having the steps of: cutting out an adaptive excitation vector of the length n from an adaptive excitation codebook; forming a target vector of the length n by adding the linear prediction residual vectors of the plurality of subframes; generating m×m impulse response matrixes using the linear prediction coefficients of the plurality of subframes; forming a n×n impulse response matrix using the m×m impulse response matrixes; calculating an evaluation measure of adaptive excitation vector quantization per pitch period candidate, using the adaptive excitation vector of the length n, the target vector of the length n and the n×n impulse response matrix; and comparing the evaluation measures with respect to the pitch period candidates and calculating a pitch period of a highest evaluation measure as a quantization result.

Advantageous Effect of the Invention

According to the present invention, by using linear prediction coefficients and linear prediction residual vectors that are generated in subframe units in CELP speech encoding that performs linear prediction encoding in subframe units, forming a target vector, an adaptive excitation vector and an impulse response matrix in frame units, and performing adaptive excitation vector quantization in frame units, it is possible to suppress an increase of the amount of calculations, expand the range of pitch period search, improve the accuracy of adaptive excitation vector quantization and, furthermore, improve the quality of CELP speech coding.

BEST MODE FOR CARRYING OUT THE INVENTION

An example case will be described with an embodiment of the present invention, where a CELP speech encoding apparatus including an adaptive excitation vector quantization apparatus divides each frame forming a speech signal of 16 kHz into two subframes, performs a linear prediction analysis of each subframe, and calculates a linear prediction coefficient and linear prediction residual vector per subframe. Unlike a conventional adaptive excitation vector quantization apparatus that performs a pitch period search per subframe to quantize an adaptive excitation vector, the adaptive excitation vector quantization apparatus according to the present embodiment groups two subframes into one frame and performs a pitch period search using 8 bits of information.

An embodiment of the present invention will be explained below in detail with reference to the accompanying drawings.

EMBODIMENT

Figure 1:
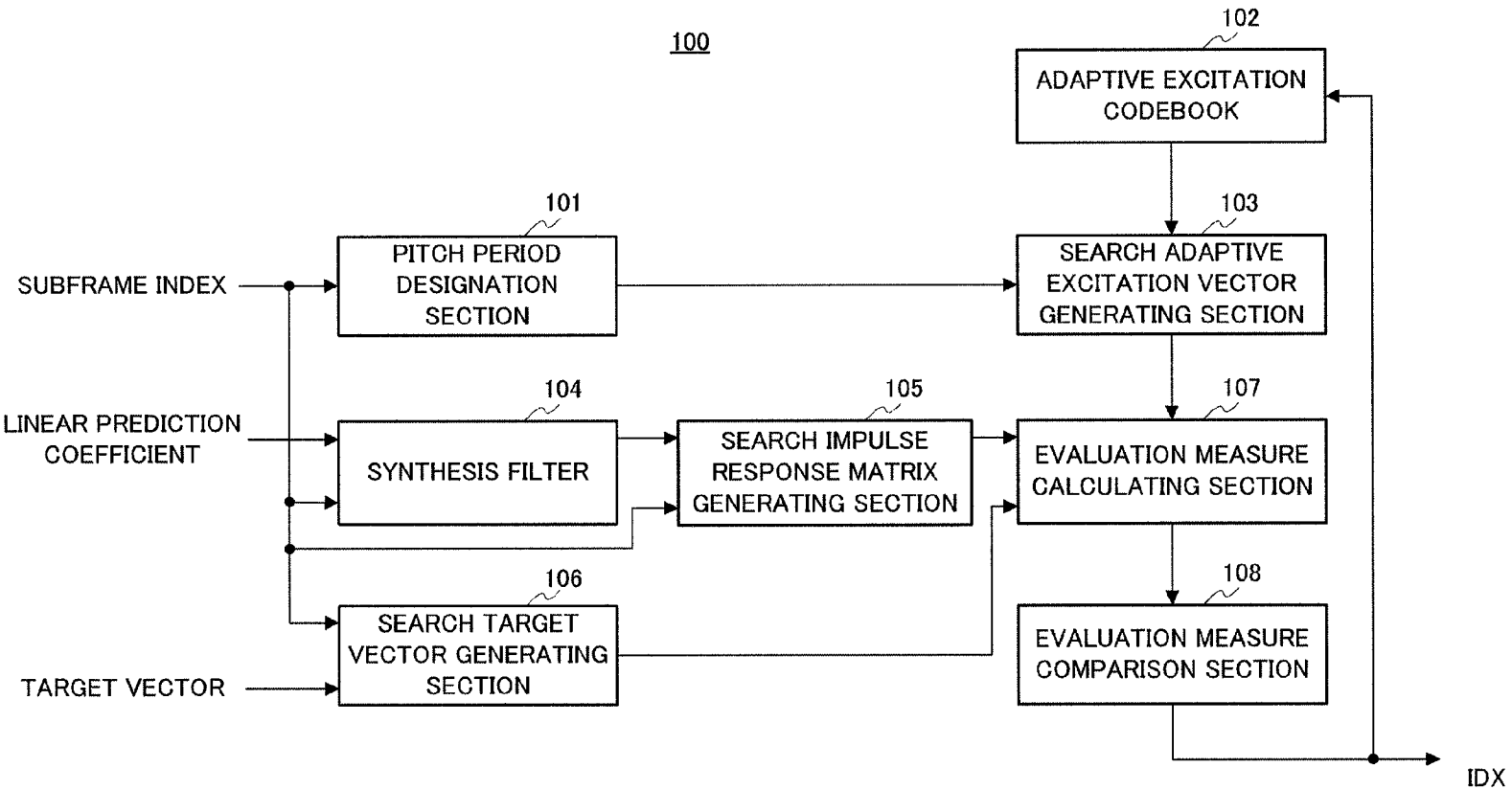
FIG. 1 is a block diagram showing main components of an adaptive excitation vector quantization apparatus according to an embodiment of the present invention.

FIG. 1 is a block diagram showing main components of adaptive excitation vector quantization apparatus according to an embodiment of the present invention.

In FIG. 1, adaptive excitation vector quantization apparatus 100 is provided with pitch period designation section 101, adaptive excitation codebook 102, search adaptive excitation vector generating section 103, synthesis filter 104, search impulse response matrix generating section 105, search target vector generating section 106, evaluation measure calculating section 107 and evaluation measure comparison section 108, and receives as input a subframe index, linear prediction coefficient and target vector per subframe. Here, the subframe index refers to the order of each subframe, which is acquired in the CELP speech encoding apparatus including adaptive excitation vector quantization apparatus 100 according to the present embodiment, in its frame. Further, the linear prediction coefficient and target vector refer to the linear prediction coefficient and linear prediction residual (excitation signal) vector of each subframe acquired by performing a linear prediction analysis of each subframe in the CELP speech encoding apparatus. For the linear prediction coefficients, LPC parameters or LSF (Line Spectral Frequency) parameters which are frequency domain parameters and which are interchangeable with the LPC parameters in one-to-one correspondence, and LSP (Line Spectral Pairs) parameters are used.

Pitch period designation section 101 sequentially designates pitch periods in a predetermined range of pitch period search, to search adaptive excitation vector generating section 103, based on subframe indices that are received as input on a per subframe basis.

Adaptive excitation codebook 102 has a built-in buffer storing excitations, and updates the excitations using a pitch period index IDX fed back from evaluation measure comparison section 108 every time a pitch period search is finished on a per frame basis.

Search adaptive excitation vector generating section 103 cuts out, from adaptive excitation codebook 102, a frame length n of an adaptive excitation vector having the pitch period designated by pitch period designation section 101, and outputs the result to evaluation measure calculating section 107 as an adaptive excitation vector for pitch period search (hereinafter abbreviated to "search adaptive excitation vector").

Synthesis filter 104 forms synthesis filters using the linear prediction coefficients that are received as input on a per subframe basis, generates impulse response matrixes of the synthesis filters based on the subframe indices that are received as input on a per subframe basis, and outputs the result to search impulse response matrix generating section 105.

Using the impulse response matrix per subframe received as input from synthesis filter 104, search impulse response matrix generating section 105 generates an impulse response matrix per frame, based on the subframe indices that are received as input on a per subframe basis, and outputs the result to evaluation measure calculating section 107 as a search impulse response matrix.

Search target vector generating section 106 generates a target vector per frame using the target vectors that are received as input on a per subframe basis, and outputs the result to evaluation measure calculating section 107 as a search target vector.

Using the search adaptive excitation vector received as input from search adaptive excitation vector generating section 103, the search impulse response matrix received as input from search impulse response matrix generating section 105 and the search target vector received as input from search target vector generating section 106, evaluation measure calculating section 107 calculates the evaluation measure for pitch period search based on the subframe indices that are received as input on a per subframe basis, and outputs the result to evaluation measure comparison section 108.

Evaluation measure comparison section 108 calculates the pitch period where the evaluation measure received as input from evaluation measure calculating section 107 is the maximum, outputs an index IDX indicating the calculated pitch period to the outside, and feeds back the index IDX to adaptive excitation codebook 102.

The sections of adaptive excitation vector quantization apparatus 100 will perform the following operations.

If a subframe index that is received as input on a per subframe basis indicates the first subframe, pitch period designation section 101 sequentially designates the pitch period T_int in a predetermined pitch period search range, to search adaptive excitation vector generating section 103. Here, the pitch period candidates in the pitch period search range are determined by the total amount of information involved in adaptive excitation vector quantization per subframe. For example, if the amount of information involved in adaptive excitation vector quantization is 4 bits for each of two subframes, the total amount of bits is 8 (=4+4) bits, and therefore there are 256 patterns of pitch period candidates from "32" to "287" in the pitch period search range. Here, "32" to "287" indicate the indices indicating pitch periods. If a subframe index that is received as input on a per subframe basis indicates the first subframe, pitch period designation section 101 sequentially designates the pitch period T_int (T_int=32, 33, . . . , 287) to search adaptive excitation vector generating section 103, and, if a subframe index indicates the second subframe, pitch period designation section 101 does not designate pitch periods to search adaptive excitation vector generating section 103.

Adaptive excitation codebook 102 has a built-in buffer storing excitations, and, using an adaptive excitation vector having the pitch period indicated by the index IDX fed back from evaluation measure comparison section 108, updates the excitations every time the pitch period search per frame is finished.

Search adaptive excitation vector generating section 103 cuts out, from adaptive excitation codebook 102, a frame length n of the adaptive excitation vector having the pitch period T_int designated by pitch period designation section 101 and outputs the result to evaluation measure calculating section 107 as the search adaptive excitation vector P(T_int). For example, in a case where adaptive excitation codebook 102 is comprised of e vectors represented by exc(0), exc(1), . . . exc(e−1), the adaptive excitation vector P(T_int) generated in search adaptive excitation vector generating section 103 can be represented by following equation 1.

(Equation 1)

$$P(\mathrm{T_int}) = P\begin{bmatrix} exc(e-\mathrm{T_int}) \\ exc(e-\mathrm{T_int}+1) \\ \vdots \\ exc(e-\mathrm{T_int}+m-1) \\ exc(e-\mathrm{T_int}+m) \\ \vdots \\ exc(e-\mathrm{T_int}+n-1) \end{bmatrix} \quad [1]$$

Figure 2:
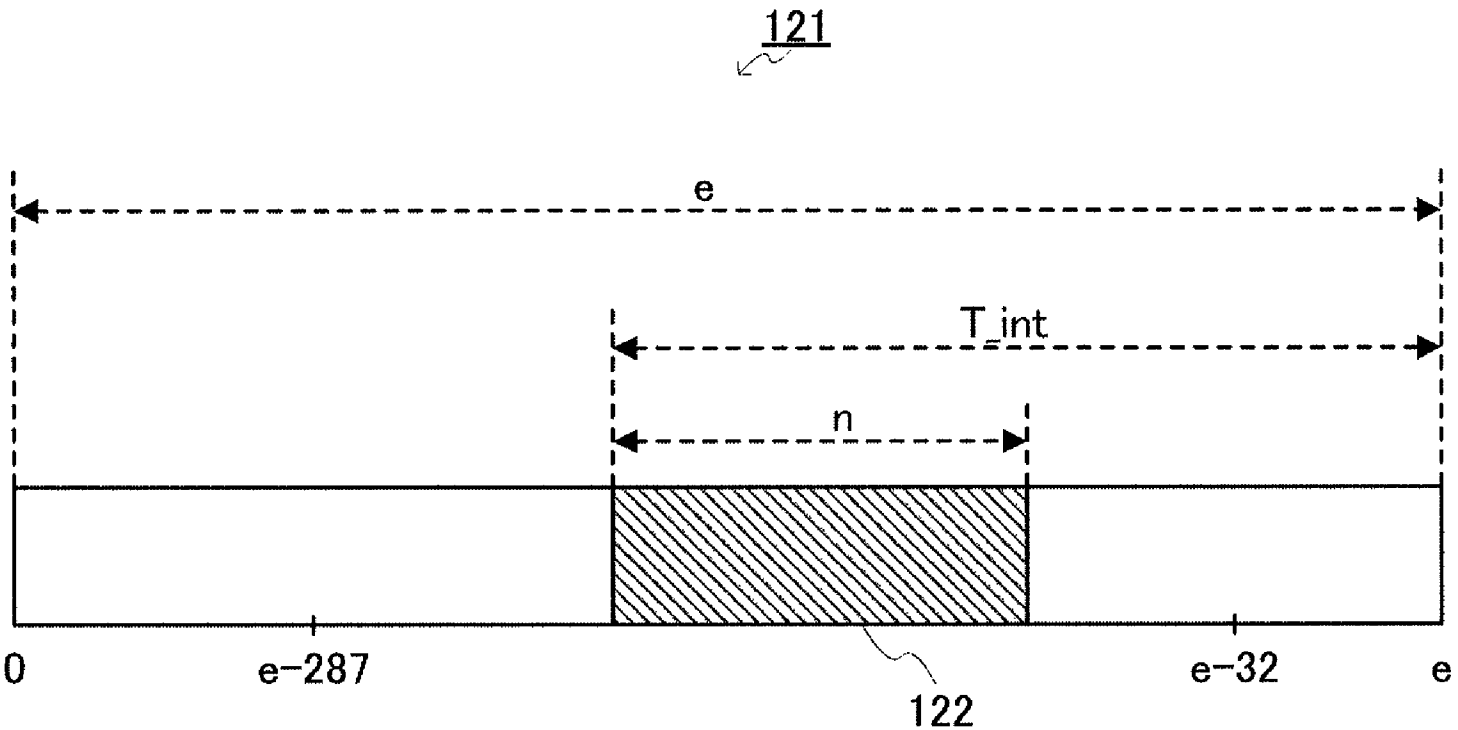
FIG. 2 illustrates an excitation produced in an adaptive excitation codebook according to an embodiment of the present invention.

FIG. 2 illustrates an excitation provided by adaptive excitation codebook 102.

In FIG. 2, e represents the length of excitation 121, n represents the length of the search adaptive excitation vector P(T_int), and T_int represents the pitch period designated by pitch period designation section 101. As shown in FIG. 2, using the point that is T_int apart from the tail end (i.e. position e) of excitation 121 (i.e. adaptive excitation codebook 102) as the start point, search adaptive excitation vector generating section 103 cuts out part 122 of a frame length n in the direction of the tail end e from the start point, and generates search adaptive excitation vector P(T_int). Here, if the value of T_int is lower than n, search adaptive excitation vector generating section 103 may duplicate the cut-out period until its length reaches the frame length. Further, search adaptive excitation vector generating section 103 repeats the cutting processing shown in the above equation 1, for 256 patterns of T_int from "32" to "287" designated by pitch period designation section 101.

Synthesis filter 104 forms a synthesis filter using input linear prediction coefficients that are received as input on a per subframe basis. Further, synthesis filter 104 generates the impulse response matrix represented by following equation 2 if a subframe index that is received as input on a per subframe basis indicates the first subframe, while generating the impulse response matrix represented by following equation 3 and outputting it to search impulse response matrix generating section 105 if a subframe index indicates the second subframe.

(Equation 2)

$$H = \begin{bmatrix} h(0) & 0 & \dots & 0 \\ h(1) & h(0) & \dots & 0 \\ \vdots & \vdots & \ddots & \vdots \\ h(n-1) & h(n-2) & \dots & h(0) \end{bmatrix} \quad [2]$$

(Equation 3)

$$\mathrm{H_ahead} = \begin{bmatrix} \mathrm{h_a}(0) & 0 & \dots & 0 \\ \mathrm{h_a}(1) & \mathrm{h_a}(0) & \dots & 0 \\ \vdots & \vdots & \ddots & \vdots \\ \mathrm{h_a}(m-1) & \mathrm{h_a}(m-2) & \dots & \mathrm{h_a}(0) \end{bmatrix} \quad [3]$$

As shown in equation 2, when the subframe index indicates the first subframe, the impulse response matrix H of a frame length n is calculated. Further, as shown in equation 3, when the subframe index indicates the second subframe, the impulse response matrix H_ahead of a subframe length m is calculated.

Taking into account that synthesis filter 104 varies between the first subframe and the second subframe, search impulse response matrix generating section 105 generates the search impulse response matrix H_new represented by following equation 4 by cutting out components of the impulse response matrixes H and H_ahead received as input from synthesis filter 104, and outputs it to evaluation measure calculating section 107.

(Equation 4)

$$\text{H_new} = \begin{bmatrix} h(0) & 0 & \dots & 0 & 0 & 0 & \dots & 0 & 0 \\ h(1) & h(0) & \dots & 0 & 0 & 0 & \dots & 0 & 0 \\ h(2) & h(1) & \dots & 0 & 0 & 0 & \dots & 0 & 0 \\ \vdots & \vdots & \ddots & \vdots & \vdots & \vdots & \ddots & \vdots & \vdots \\ h(m-1) & h(m-2) & \dots & h(0) & 0 & 0 & \dots & 0 & 0 \\ h(m) & h(m-1) & \dots & h(1) & \text{h_a}(0) & 0 & \dots & 0 & 0 \\ h(m+1) & h(m) & \dots & h(2) & \text{h_a}(1) & \text{h_a}(0) & \dots & 0 & 0 \\ \vdots & \vdots & \ddots & \vdots & \vdots & \vdots & \ddots & \vdots & \vdots \\ h(n-2) & h(n-3) & \dots & h(m-1) & \text{h_a}(m-2) & \text{h_a}(m-3) & \dots & \text{h_a}(0) & 0 \\ h(n-1) & h(n-2) & \dots & h(m) & \text{h_a}(m-1) & \text{h_a}(m-2) & \dots & \text{h_a}(1) & \text{h_a}(0) \end{bmatrix} \quad [4]$$

If a subframe index that is received as input on a per subframe basis indicates the first subframe, search target vector generating section 106 stores the target vector represented by X1=[x(0) x(2) . . . x(m−1)] received as input. Further, if a subframe index that is received as input on a per subframe basis indicates the second subframe, search target vector generating section 106 generates the search target vector shown in following equation 5 by adding the target vector represented by input X2=[x(m) x(m+1) . . . x(n−1)] and the stored target vector X1, and outputs the generated search target vector to evaluation measure calculating section 107.

[5]

$$X=[x(0)x(1)\dots x(m-1)x(m)\dots x(n-1)] \quad \text{(Equation 5)}$$

Using the adaptive excitation vector P(T_int) received as input from search adaptive excitation vector generating section 103, the search impulse response matrix H_new received as input from search impulse response matrix generating section 105 and the target vector X received as input from search target vector generating section 106, evaluation measure calculating section 107 calculates the evaluation measure Dist(T_int) for pitch period search according to following equation 6, and outputs the result to evaluation measure comparison section 108. As shown in following equation 6, evaluation measure calculating section 107 calculates, as an evaluation measure, the square error between the search target vector generated in search target vector generating section 106 and the reproduced vector, which is acquired by convoluting the search impulse response matrix H_new generated in search impulse response matrix generating section 105 and the search adaptive excitation vector P(T_int) generated in search adaptive excitation vector generating section 103. Further, upon calculating the evaluation measure Dist(T_int) in evaluation measure calculating section 107, instead of the search impulse response matrix H_new in following equation 6, the matrix H'_new is generally used which is acquired by multiplying the search impulse response matrix H_new and the impulse response matrix W in the perceptual weighting filter included in the CELP speech encoding apparatus (i.e. H_new×W). However, in the following explanation, H_new and H'_new are not distinguished, and both will be referred to as "H_new."

(Equation 6)

$$Dist(\text{T_int}) = \frac{(XHP(\text{T_int}))^2}{|HP(\text{T_int})|^2} \quad [6]$$

Evaluation measure comparison section 108 performs comparison between, for example, 256 patterns of evaluation measure Dist(T_int) received as input from evaluation measure calculating section 107, and finds the pitch period T_int' associated with the maximum evaluation measure Dist (T_int). Evaluation measure comparison section 108 outputs the index IDX indicating the found pitch period T_int' to the outside and adaptive excitation codebook 102.

The CELP speech encoding apparatus including adaptive excitation vector quantization apparatus 100 transmits speech encoded information including the pitch period index IDX generated in evaluation measure comparison section 108, to the CELP decoding apparatus including the adaptive excitation vector dequantization apparatus according to the present embodiment. The CELP decoding apparatus acquires the pitch period index IDX by decoding the received speech encoded information and then inputs the pitch period index IDX in the adaptive excitation vector dequantization apparatus according to the present embodiment. Further, like the speech encoding processing in the CELP speech encoding apparatus, speech decoding processing in the CELP decoding apparatus is also performed in subframe units, and the CELP decoding apparatus inputs subframe indices in the adaptive excitation vector dequantization apparatus according to the present embodiment.

Figure 3:
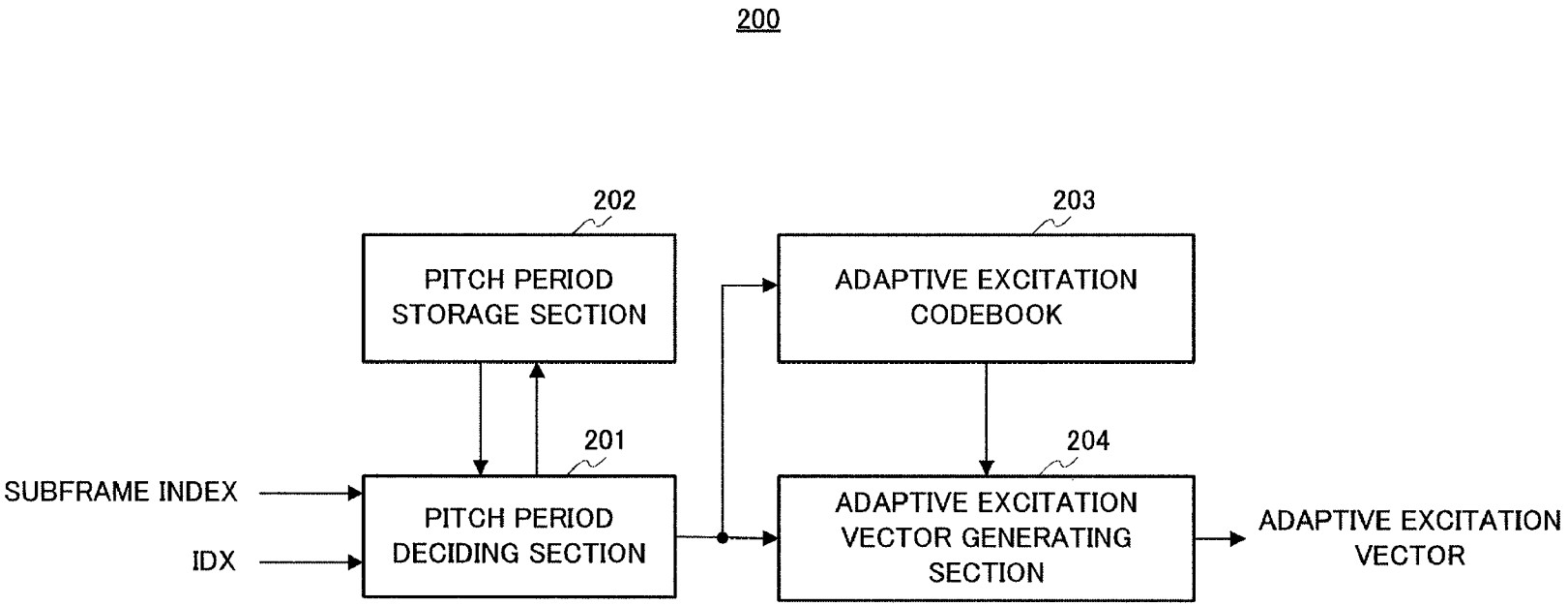
FIG. 3 is a block diagram showing main components of an adaptive excitation vector dequantization apparatus according to an embodiment of the present invention.

FIG. 3 is a block diagram showing main components of adaptive excitation vector dequantization apparatus 200 according to the present embodiment.

In FIG. 3, adaptive excitation vector dequantization apparatus 200 is provided with pitch period deciding section 201, pitch period storage section 202, adaptive excitation codebook 203 and adaptive excitation vector generating section 204, and receives as input the subframe indices and pitch period index IDX generated in the CELP speech decoding apparatus.

If a subframe index indicates the first subframe, pitch period deciding section 201 outputs the pitch period T_int' associated with the pitch period index IDX received as input, to pitch period storage section 202, adaptive excitation codebook 203 and adaptive excitation vector generating section 204. If a subframe index indicates the second subframe, pitch period deciding section 201 reads the pitch period T_int' stored in pitch period storage section 202 and outputs it to adaptive excitation codebook 203 and adaptive excitation vector generating section 204.

Pitch period storage section 202 stores the pitch period T_int' of the first subframe, which is received as input from pitch period deciding section 201, and pitch period deciding section 201 reads the pitch period T_int' in processing of the second subframe.

Adaptive excitation codebook 203 has a built-in buffer storing the same excitations as the excitations provided in adaptive excitation codebook 102 of adaptive excitation vector quantization apparatus 100, and updates the excitations using the adaptive excitation vector having the pitch period T_int' received as input from pitch period deciding section 201 every time adaptive excitation decoding processing is finished on a per subframe basis.

Adaptive excitation vector generating section 204 cuts out, from adaptive excitation codebook 203, a subframe length m of the adaptive excitation vector P'(T_int') having the pitch period T_int' received as input from pitch period deciding section 201, and outputs the result as the adaptive excitation vector per subframe. The adaptive excitation vector P'(T_int') generated in adaptive excitation vector generating section 204 is represented by following equation 7.

(Equation 7)

$$P'(\mathrm{T_int'}) = P'\begin{bmatrix} exc(e-\mathrm{T_int'}) \\ exc(e-\mathrm{T_int'}+1) \\ \vdots \\ exc(\mathrm{e_T_int'}+m-1) \end{bmatrix} \quad [7]$$

Thus, according to the present embodiment, in the CELP speech encoding for performing linear prediction encoding in subframe units, the adaptive excitation vector quantization apparatus forms a target vector, an adaptive excitation vector and an impulse response matrix in frame units using the linear prediction coefficient and linear prediction residual vector in subframe units, and performs adaptive excitation vector quantization on a per frame basis. By this means, it is possible to suppress an increase of the amount of calculations, expand a range of pitch period search and improve the accuracy of adaptive excitation vector quantization and, furthermore, quality of CELP speech coding.

Further, although an example case has been described above with the present embodiment where search impulse response matrix generating section 105 calculates the search impulse response matrix represented by above-described equation 4, the present invention is not limited to this, and it is equally possible to calculate the search impulse response matrix represented by following equation 8. Furthermore, without using above-described equations 6 and 8, it is equally possible to calculate an accurate search impulse response matrix according to the transition of the synthesis filter between the first subframe and the second subframe. However, in a case where an accurate search impulse response matrix is calculated, the amount of calculations increases.

(Equation 8)

$$\mathrm{H_new} = \begin{bmatrix} h(0) & 0 & \dots & 0 & 0 & 0 & \dots & 0 & 0 \\ h(1) & h(0) & \dots & 0 & 0 & 0 & \dots & 0 & 0 \\ h(2) & h(1) & \dots & 0 & 0 & 0 & \dots & 0 & 0 \\ \vdots & \vdots & \ddots & \vdots & \vdots & \vdots & \ddots & \vdots & \vdots \\ h(m-1) & h(m-2) & \dots & h(0) & 0 & 0 & \dots & 0 & 0 \\ 0 & \mathrm{h_a}(m-1) & \dots & \mathrm{h_a}(1) & \mathrm{h_a}(0) & 0 & \dots & 0 & 0 \\ 0 & 0 & \dots & \mathrm{h_a}(2) & \mathrm{h_a}(1) & \mathrm{h_a}(0) & \dots & 0 & 0 \\ \vdots & \vdots & \ddots & \vdots & \vdots & \vdots & \ddots & \vdots & \vdots \\ 0 & 0 & \dots & \mathrm{h_a}(m-1) & \mathrm{h_a}(m-2) & \mathrm{h_a}(m-3) & \dots & \mathrm{h_a}(0) & 0 \\ 0 & 0 & \dots & 0 & \mathrm{h_a}(m-1) & \mathrm{h_a}(m-2) & \dots & \mathrm{h_a}(1) & \mathrm{h_a}(0) \end{bmatrix} \quad [8]$$

Further, although an example case has been described above with the present embodiment where evaluation measure calculating section 107 calculates the evaluation measure Dist(T_int) according to above-described equation 6 using the search target vector X of the frame length n, the search adaptive excitation vector P(T_int) and the search impulse response matrix H_new of the n×n matrix, the present invention is not limited to this. Further, in evaluation measure calculating section 107, it is equally possible to set in advance constant r, where m≦r<n, newly form the search target vector X of the length of constant r, the search adaptive excitation vector P(T_int) of the length of constant r and the search impulse response matrix H_new, which is a r×r matrix of the length of constant r, by extracting elements up to the r-th order of search target vector X, elements up to the r-th order of search adaptive excitation vector P(T_int) and elements up to the r×r search impulse response matrix H_new, and then calculate the evaluation measure Dist(T_int).

Further, although an example case has been described above with the present embodiment where a linear prediction residual vector is received as input and a pitch period of the linear prediction residual vector is searched for with an adaptive excitation codebook, the present invention is not limited to this, and it is equally possible to receive as input a speech signal as is and directly search for the pitch period of the speech signal.

Further, although an example case has been described above with the present embodiment where 256 patterns of pitch period candidates from "32" to "287" are used, the present invention is not limited to this, and it is equally possible to set a different range for pitch period candidates.

Further, although a case has been assumed and described with the present embodiment where a CELP speech encoding apparatus including adaptive excitation vector quantization apparatus 100 divides one frame into two subframes and performs a linear prediction analysis of each subframe, the present invention is not limited to this, and it is equally possible to assume that a CELP speech encoding apparatus divides one frame into three subframes or more and perform a linear prediction analysis of each subframe. Further, in an assumption where each subframe is further divided into two sub-subframes and a linear prediction analysis of each sub-subframe is performed, it is equally possible to apply the present invention. To be more specific, if a CELP speech encoding apparatus calculates a linear prediction coefficient and linear prediction residual by dividing one frame into two subframes, further dividing each subframe into two sub-subframes and performing a linear prediction analysis of each sub-subframe, adaptive excitation vector quantization apparatus 100 needs to form two subframes with four sub-subframes, form one frame with two subframes and perform a pitch period search of the resulting frame.

The adaptive excitation vector quantization apparatus and adaptive excitation vector dequantization apparatus according to the present invention can be mounted on a communication terminal apparatus in a mobile communication system that transmits speech, so that it is possible to provide a communication terminal apparatus having the same operational effect as above.

Although a case has been described above with the above embodiments as an example where the present invention is implemented with hardware, the present invention can be implemented with software. For example, by describing the adaptive excitation vector quantization method and adaptive excitation vector dequantization method according to the present invention in a programming language, storing this program in a memory and making the information processing section execute this program, it is possible to implement the same function as the adaptive excitation vector quantization apparatus and adaptive excitation vector dequantization apparatus according to the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2006-338342, filed on Dec. 15, 2006, including the specification, drawings and abstract, is included herein by reference in its entirety.

INDUSTRIAL APPLICABILITY

The adaptive excitation vector quantization apparatus, adaptive excitation vector dequantization apparatus and adaptive excitation vector quantization and dequantization methods according to the present invention are applicable to speech coding, speech decoding and so on.

The invention claimed is:

1. An adaptive excitation vector quantization apparatus that is used in code excited linear prediction speech encoding to generate linear prediction residual vectors of a length m and linear prediction coefficients by dividing a frame of a length n into a plurality of subframes of the length m and performing a linear prediction analysis, (the length n and the length m being integers, the length n being a multiple of the length m, the apparatus comprising:

an adaptive excitation vector generator including at least one of at least one processor and at least one circuit that cuts out an adaptive excitation vector of the length n from an adaptive excitation codebook;

a target vector generator including at least one of the at least one processor and the at least one circuit that forms a target vector of the length n by adding the linear prediction residual vectors of the plurality of subframes;

a synthesis filter including at least one of the at least one processor and the at least one circuit that generates m×m impulse response matrixes using the linear prediction coefficients of the plurality of subframes;

an impulse response matrix former including at least one of the at least one processor and the at least one circuit that forms a n×n impulse response matrix using the m×m impulse response matrixes;

an evaluation measure calculator including at least one of the at least one processor and the at least one circuit that calculates an evaluation measure of an adaptive excitation vector quantization per each pitch period candidate, using the adaptive excitation vector of the length n, the target vector of the length n and the n×n impulse response matrix; and an evaluation measure comparator including at least one of the at least one processor and the at least one circuit that compares the evaluation measure with respect to each pitch period candidate and calculates a pitch period of a highest evaluation measure as a quantization result.

2. A code excited linear prediction speech encoding apparatus comprising the adaptive excitation vector quantization apparatus according to claim 1.

3. The adaptive excitation vector quantization apparatus according to claim 1, wherein a new impulse response matrix is formed by extracting components of the n×n impulse response matrix and the m×m impulse response matrixes and by rearranging the extracted components.

4. The adaptive excitation vector quantization apparatus according to claim 1, further comprising:

a pitch period designator including at least one of the at least one processor and the at least one circuit that sequentially designates pitch periods of a pitch period search range to the adaptive excitation vector generator when a first subframe of the plurality of subframes is received and that does not sequentially designate the pitch periods to the adaptive excitation vector generator when a second subframe of the plurality of subframes is received.

5. An adaptive excitation vector quantization method that is used in code excited linear prediction speech encoding to generate linear prediction residual vectors of a length m and linear prediction coefficients by dividing a frame of a length n into a plurality of subframes of the length m and performing a linear prediction analysis, (the length n and the length m being integers, the length n being a multiple of the length m, the method comprising:

cutting out, with at least one of at least one processor and at least one circuit, an adaptive excitation vector of the length n from an adaptive excitation codebook;

forming, with at least one of the at least one processor and the at least one circuit, a target vector of the length n by adding the linear prediction residual vectors of the plurality of subframes;

generating, with at least one of the at least one processor and the at least one circuit, m×m impulse response matrixes using the linear prediction coefficients of the plurality of subframes;

forming, with at least one of the at least one processor and the at least one circuit, a n×n impulse response matrix using the m×m impulse response matrixes;

calculating, with at least one of the at least one processor and the at least one circuit, an evaluation measure of adaptive excitation vector quantization per pitch period candidate, using the adaptive excitation vector of the length n, the target vector of the length n and the n×n impulse response matrix; and comparing, with at least one of the at least one processor and the at least one circuit, the evaluation measures with respect to the pitch period candidates and calculating a pitch period of a highest evaluation measure as a quantization result.

6. The adaptive excitation vector quantization method according to claim 5, wherein the impulse response matrix former forms a new impulse response matrix by extracting components of the n×n impulse response matrix and the m×m impulse response matrixes and by rearranging the extracted components.

7. The adaptive excitation vector quantization method according to claim 5, further comprising:

sequentially designating pitch periods of a pitch period search range to the adaptive excitation vector generator when a first subframe of the plurality of subframes is received, wherein the pitch periods are not sequentially designated to the adaptive excitation vector generator when a second subframe of the plurality of subframes is received.

* * * * *

UNITED STATES PATENT AND TRADEMARK OFFICE

CERTIFICATE OF CORRECTION

PATENT NO. : 8,200,483 B2
APPLICATION NO. : 12/518944
DATED : June 12, 2012
INVENTOR(S) : Sato et al.

It is certified that error appears in the above-identified patent and that said Letters Patent is hereby corrected as shown below:

IN THE CLAIMS:

Column 12, line 7, Claim 1 (Lines 4-5) please change “analysis, (the length n” to --analysis, the length n--.

Column 12, line 62, Claim 5 (Lines 4-5) please change “analysis, (the length n” to --analysis, the length n--.

Signed and Sealed this
Fourth Day of September, 2012

David J. Kappos

David J. Kappos
*Director of the United States Patent and Trademark Office*